US008926896B2

(12) United States Patent
Wakade et al.

(10) Patent No.: US 8,926,896 B2
(45) Date of Patent: Jan. 6, 2015

(54) METHOD OF COMPACTING A FIRST POWDER MATERIAL AND A SECOND POWDER MATERIAL

(75) Inventors: Shekhar G. Wakade, Grand Blanc, MI (US); Mark A. Osborne, Grand Blank, MI (US); William L. Miller, Birmingham, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1390 days.

(21) Appl. No.: 12/144,740

(22) Filed: Jun. 24, 2008

(65) Prior Publication Data

US 2009/0317653 A1 Dec. 24, 2009

(51) Int. Cl.

| | |
|---|---|
| ***B22F 7/02*** | (2006.01) |
| ***B22F 3/12*** | (2006.01) |
| ***B22F 5/10*** | (2006.01) |
| ***B22F 5/12*** | (2006.01) |
| ***B22F 7/06*** | (2006.01) |

(52) U.S. Cl.

CPC . *B22F 3/12* (2013.01); *B22F 5/106* (2013.01); *B22F 5/12* (2013.01); *B22F 7/06* (2013.01); *B22F 2999/00* (2013.01)

USPC ..... 419/6; 419/66; 428/548

(58) Field of Classification Search

USPC ..... 419/8, 6

See application file for complete search history.

(56) References Cited

U.S. PATENT DOCUMENTS

| | | | | |
|---|---|---|---|---|
| 3,780,418 | A * | 12/1973 | Hurst | 419/42 |
| 5,405,574 | A | 4/1995 | Chelluri et al. | |
| 5,611,139 | A | 3/1997 | Chelluri et al. | |
| 5,611,230 | A | 3/1997 | Chelluri et al. | |
| 5,689,797 | A | 11/1997 | Chelluri et al. | |
| 2003/0051614 | A1* | 3/2003 | Knoth et al. | 100/917 |
| 2005/0001499 | A1 | 1/2005 | Calico | |
| 2005/0153156 | A1* | 7/2005 | Miyoshi et al. | 428/613 |

FOREIGN PATENT DOCUMENTS

DE 10050703 A1 4/2001

OTHER PUBLICATIONS

German Office Action dated Oct. 15, 2012; Applicant: GM Global Technology Operations LLC; Applicant SN: 102009025584.2; 7 pages.

* cited by examiner

*Primary Examiner* — Jessee Roe
*Assistant Examiner* — Christopher Kessler
(74) *Attorney, Agent, or Firm* — BrooksGroup

(57) ABSTRACT

One embodiment includes providing a first layer including a first powder material and a second layer including a second powder material over the first layer, and compacting the first powder material and the second powder material using at least a first magnetic field.

8 Claims, 4 Drawing Sheets

METHOD OF COMPACTING A FIRST POWDER MATERIAL AND A SECOND POWDER MATERIAL

TECHNICAL FIELD

The field to which the disclosure generally relates includes compacting powder materials.

BACKGROUND

It is known to compact powder-like and/or particulate material using a magnetic field to form a compacted product. A compacted product, for example a metal product, may have a reduced mass compared to a metal product formed by casting.

SUMMARY OF EXEMPLARY EMBODIMENTS OF THE INVENTION

One embodiment includes providing a first layer including a first powder material and a second layer including a second powder material over the first layer, and compacting the first powder material and the second powder material using at least a first magnetic field.

Other exemplary embodiments of the invention will become apparent from the detailed description provided hereinafter. It should be understood that the detailed description and specific examples, while disclosing exemplary embodiments of the invention, are intended for purposes of illustration only and are not intended to limit the scope of the invention.

BRIEF DESCRIPTION OF THE DRAWINGS

Exemplary embodiments of the invention will become more fully understood from the detailed description and the accompanying drawings, wherein.

DETAILED DESCRIPTION OF EXEMPLARY EMBODIMENTS

The following description of the embodiment(s) is merely exemplary (illustrative) in nature and is in no way intended to limit the invention, its application, or uses.

One exemplary embodiment includes a method of compacting a first powder-like and/or particulate material and a second powder-like and/or particulate material. The compacting of the first powder-like and/or particulate material and the second powder-like and/or particulate material may be used to produce a variety of products including, but not limited to, thin walled cylinder liners for engine blocks. In one exemplary embodiment, a first layer including the first powder-like and/or particulate material is provided and a second layer including the second powder-like and/or particulate material is provided and they are compacted together. The first and second powder-like and/or particulate materials may be, for example but not limited to, metals, metal alloys, metal compounds, ceramic compounds, and ceramic and metal composites. In one embodiment, the first powder-like and/or particulate material may be a ferrous alloy and the second powder-like and/or particulate material may be a non-ferrous alloy, for example, but not limited to, an aluminum or magnesium alloy. In another embodiment, the first powder-like and/or particulate material may be a non-ferrous alloy and the second powder-like and/or particulate material may be a non-ferrous alloy.

Figure 1:
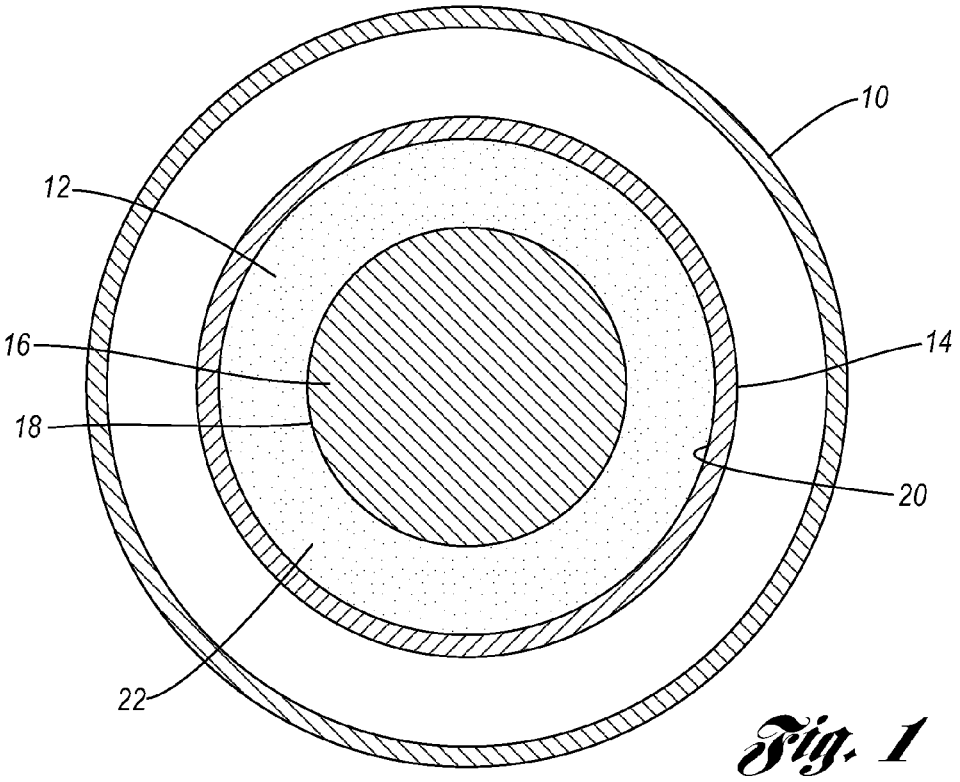
FIG. 1 illustrates a method according to one embodiment.

The compacting of the first powder-like and/or particulate material and/or the second powder-like and/or particulate material may be accomplished using a magnetic field. In one exemplary embodiment, the compacting may be accomplished using a dynamic magnetic compaction (DMC) process. The DMC process uses electromagnetic forming of one or more substrates or containers overlying or holding the powder-like and/or particulate material. Referring to FIG. 1, in one embodiment a magnetic field generating component such as, but not limited to, a coil 10 is provided. At least a first powder-like and/or particulate material 12 may be placed in a first electrically conductive container or sleeve 14. The first electrically conductive container 14 may include an electrically conductive material such as, but not limited to, copper, silver, aluminum, stainless steel and alloys thereof. The magnetic field generating component may be operated to produce a first magnetic field.

In one embodiment, the magnetic field generating component, for example the electrically conductive coil 10, may be positioned to surround the first electrically conductive container 14. In one embodiment, an electrical supply source separate from the container 14 may provide electrical energy to the electrically conductive coil 10 in the form of a rapid current pulse. The first magnetic field may be produced when the electrical current is passed through the electrically conductive coil 10.

Figure 2:
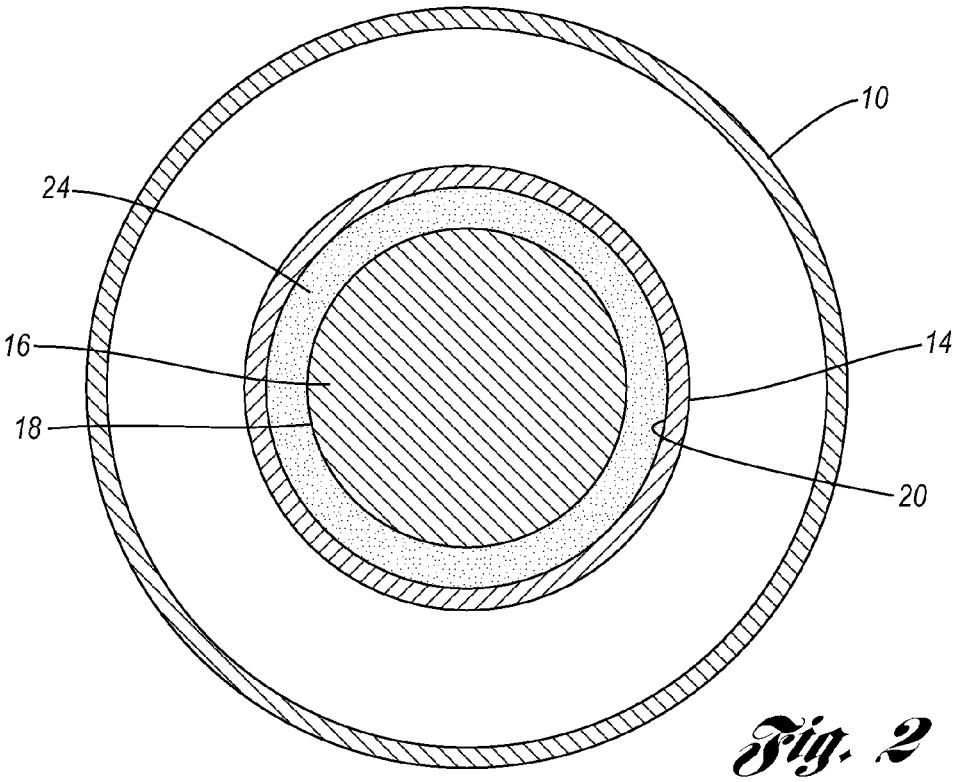
FIG. 2 illustrates a method according to one embodiment.

The magnetic field generating component 10 and the first container 14 including at least the first powder-like and/or particulate material 12 may be constructed and arranged so that the first magnetic field induces a current in the first container 14 and so that the induced current produces a second magnetic field. In one exemplary embodiment, the first container 14 may be placed in the coil 10 so that at least the portion of the first container 14 with the at least first powder-like and/or particulate material 12 is received within the coil. The first magnetic field and the second magnetic field are of such magnitude and direction that they repel each other and so that the first container 14 is compressed. Referring to FIG. 2, as the first container 14 is being compressed, a wall of the container applies pressure on the first powder-like and/or particulate material 12, compacting the same. In one embodiment, a die (not shown) may be positioned inside the container 14 and the first powder-like and/or particulate material 12 may be placed in the container 14 so as to surround the die.

This compaction creates a dense body of material. This dense body may be known as the green (unsintered) compact. The DMC method results in a stronger green compact with a higher uniform density than one produced by conventional powder metallurgical processes. For example, the DMC process typically produces a green compact having a density in excess of 90% of theoretical density, where theoretical density is defined as the density of a material containing no porosity or imperfections of any kind. However, the density of green compacts formed by the DMC process is more commonly about 95% of theoretical density. In another embodiment, the density of green compacts formed by the DMC process may be in excess of 95% of theoretical density. The green compact may be near-net shape.

Figure 3:
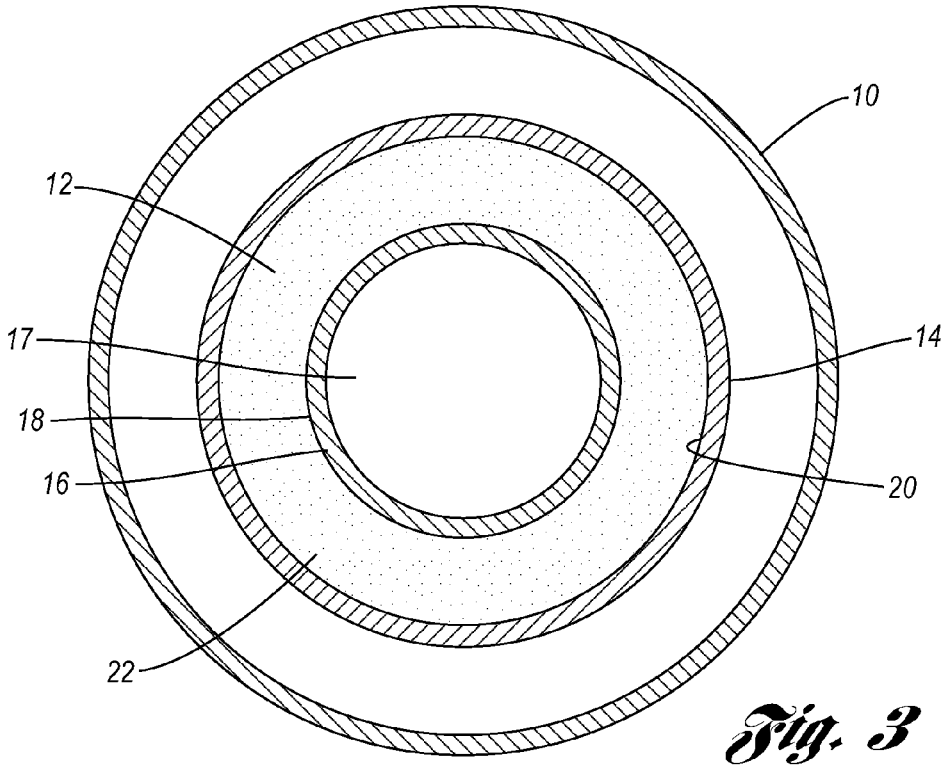
FIG. 3 illustrates a method according to one embodiment.

Referring now to FIG. 1, in one exemplary embodiment, a core 16 may be positioned inside of the first container 14. In one embodiment, the core 16 may be a solid cylindrical core as shown in FIG. 1. As shown in FIG. 3, in another embodiment the core 16 may be hollow, for example the core 16 may include a cylindrical wall having a central bore 17. Referring now to FIG. 1, the core 16 may include a first inner cylindrical wall 18, and the first container 14 may include a second outer spaced apart concentric cylindrical wall 20 to provide a first gap, space or void 22 between the first inner cylindrical wall 18 and the second outer cylindrical wall 20. At least the first powder-like and/or particulate material 12 may be placed in the first void 22.

As described above, the dimensions of the first container 14 may be reduced by the process as the first powder and/or particulate material 12 is compacted, as shown in FIG. 2. Still referring to FIG. 2, in one embodiment the compaction process produces a first compacted shell 24, for example a cylindrical shell, of the first powder and/or particulate material 12. In one embodiment, at least a portion of the surface of at least one of the first container 14 or the core 16 may include some form of suitable lubrication to assist in the separation of the first container 14 and/or the core 16 from the first compacted shell 24. The first container 14 may be separated from the first compacted shell 24, for example, by pressing it out by applying a load on a wall of the first container 14 such that the first container 14 slides off of the first compacted shell 24. Thereafter, if desired, all or portions of the first compacted shell 24 of powder and/or particulate material may be sintered to bring the first compacted shell 24 to the desired strength. The sintering process may enhance the mechanical properties of the compacted shell due to the diffusional bonding of the particles to one another.

In one embodiment, sintering may further increase the density of the first compacted shell 24 of powder and/or particulate material. In various embodiments, the sintering may be accomplished using a conventional sintering process or an induction heating process that provides a protective atmosphere. In a conventional sintering process, the first compacted shell 24 may be transported through a furnace in a suitable atmosphere to heat the first compacted shell while preventing oxidation of the first compacted shell. In an induction heating process, the first compacted shell 24 may be placed inside an induction coil, and a protective atmosphere may be provided around the first compacted shell to prevent undesirable changes in the surface chemistry or microstructure of the shell. AC current is sent through the induction coil and the resulting magnetic field induces eddy currents, which generate localized heat to heat the first compacted shell 24.

In one embodiment, the first compacted shell 24 of powder and/or particulate material may be sinter hardened. Sinter hardening may include sintering, as described above, followed by a quenching operation. In one embodiment, the quenching of the first compacted shell 24 immediately follows sintering in a manner known in the art, for example but not limited to, the use of quench rings on induction heating equipment. For example, following the sintering of the first compacted shell 24 of the first powder and/or particulate material 12, the shell may be removed from the heating fixture and dropped into a tank containing quench media, or the component may be removed from the heating fixture and may be subjected to quenching by any appropriate auxiliary means.

In one exemplary embodiment, a second compacted shell 26 of a second powder-like and/or particulate material 28 may be formed over the first powder-like and/or particulate material 12 or over the first compacted shell 24 of the first powder-like and/or particulate material 12.

Figure 4:
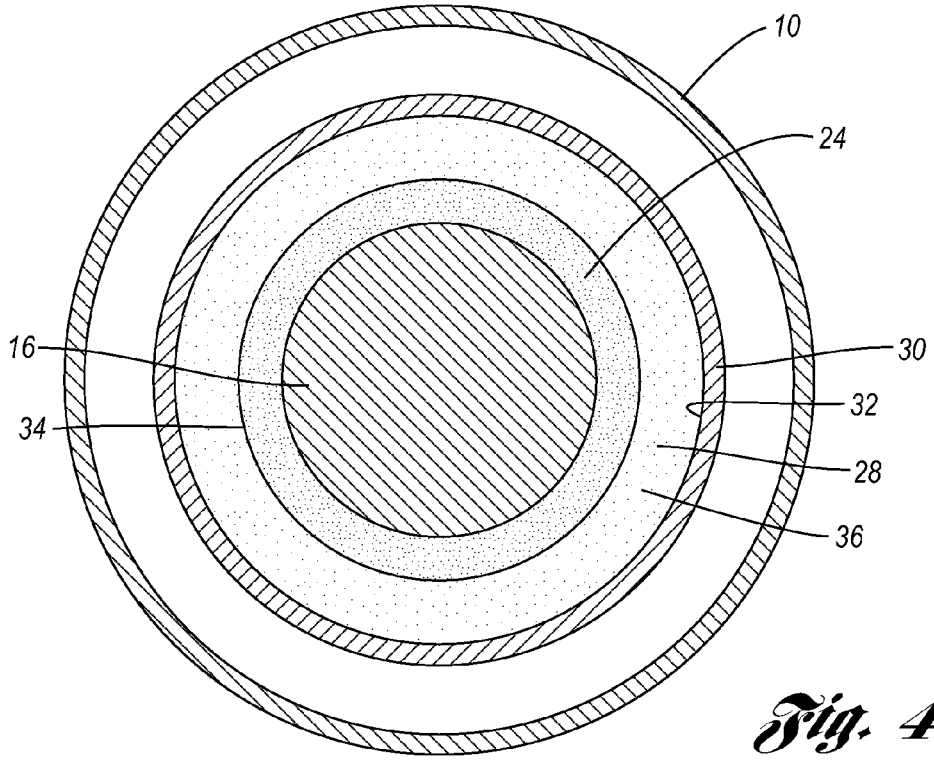
FIG. 4 illustrates a method according to one embodiment.
Figure 5:
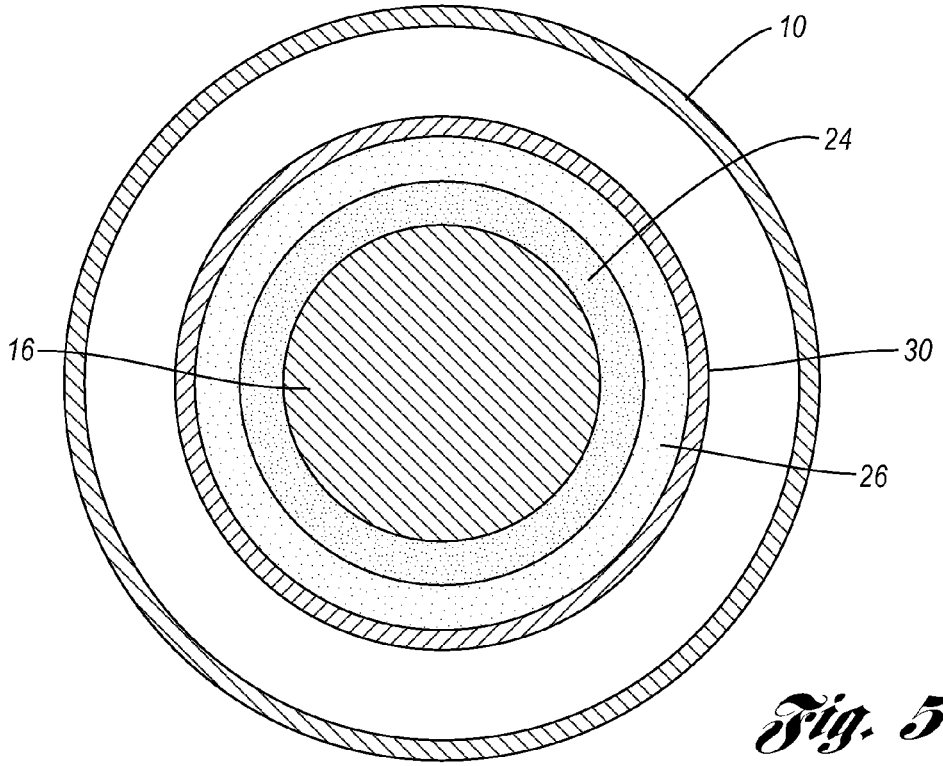
FIG. 5 illustrates a method according to one embodiment.

Referring now to FIG. 4, in one exemplary embodiment, the first compacted shell 24 of the first powder or particulate material 12 and the core 16 may be placed in a second electrically conductive container 30. The core 16 may be a solid cylindrical core as shown in FIG. 4 or a cylindrical wall having a central bore 17 as shown in FIG. 3. As shown in FIG. 4, the second electrically conductive container 30 may include a third cylindrical wall 32, and the first compacted shell 24 may include an outer surface or fourth cylindrical wall 34. A second gap, space or void 36 is provided between the third cylindrical wall 32 and the fourth cylindrical wall 34. The second electrically conductive container 30 may include an electrically conductive material such as, but not limited to, copper, silver, aluminum, stainless steel and alloys thereof. The second powder-like and/or particulate material 28 may be provided in the second void 36. Referring to FIG. 5, the above-described DMC process may be repeated compressing the second container 30 and compacting the second powder-like and/or particulate material 28 to form a second compacted shell 26 of the second powder and/or particulate material 28. The second compacted shell 26 and the first compacted shell 24 may be bonded together.

In one embodiment, at least a portion of the surface of at least one of the second container 30 or the core 16 may include some form of suitable lubrication to assist in the separation of the second container 30 and/or the core 16 from the second compacted shell 26. The second container 30 may be separated from the second compacted shell 26, for example, by pressing it out by applying a load on a wall of the second container 30 such that the second container 30 slides off of the second compacted shell 26 (shown in FIG. 5). Thereafter, if desired, all or portions of the second compacted shell 26 of the second powder and/or particulate material 28 may be sintered to bring the second compacted shell to the desired density. In one embodiment the second compacted shell 26 may be sintered using a conventional sintering process or an induction heating process that is customized for the second shell material for time and temperature. For example, in one embodiment the first compacted shell 24 may be ferrous and the second compacted shell 26 may be non-ferrous. Therefore, the temperature required for sintering the non-ferrous second compacted shell is significantly lower than the temperature required for sintering the ferrous first compacted shell. In one embodiment, sintering may further increase the density of the second compacted shell 26. In one embodiment, the second compacted shell 26 may be sinter hardened, as described above.

Figure 6:
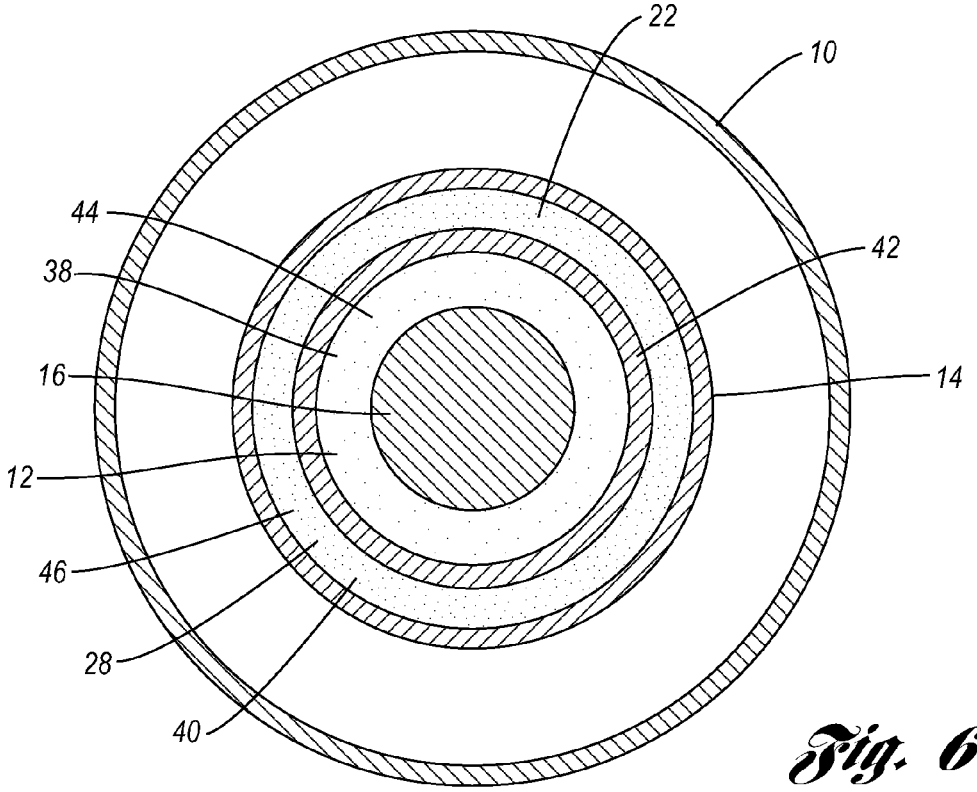
FIG. 6 illustrates a method according to one embodiment.

Referring now to FIG. 6, in another embodiment, a first layer 38 of the first powder-like and/or particulate material 12 and a second layer 40 of the second powder-like and/or particulate material 28 may be placed in the first container 14 together and compacted together. This may be accomplished in a variety of ways. For example, in one embodiment shown in FIG. 6, a temporary barrier or divider 42 may be provided in the first void 22 to divide the first void 22 into a first void portion 44 and a second void portion 46. The first powder-like material 12 may be placed in the first void portion 44 and the second powder-like material 28 may be placed in the second void portion 46 and the temporary divider 42 removed thereafter allowing the first powder-like material 12 and second powder-like material 28 to fill the space previously occupied by the temporary barrier 42 (not shown). The first layer 38 of the first powder-like material 12 and the second layer 40 of the second powder-like material 28 may be compacted together in one step utilizing the DMC process as described above.

Thereafter, if desired, all or portions of the resultant compact including the first powder-like and second powder-like materials 12, 28 may be selectively sintered using inductive heating by the application of singular or dual frequency. All or portions of the resultant compact including the first powder-like and second powder-like materials 12, 28 may also be sinter hardened.

Figure 7:
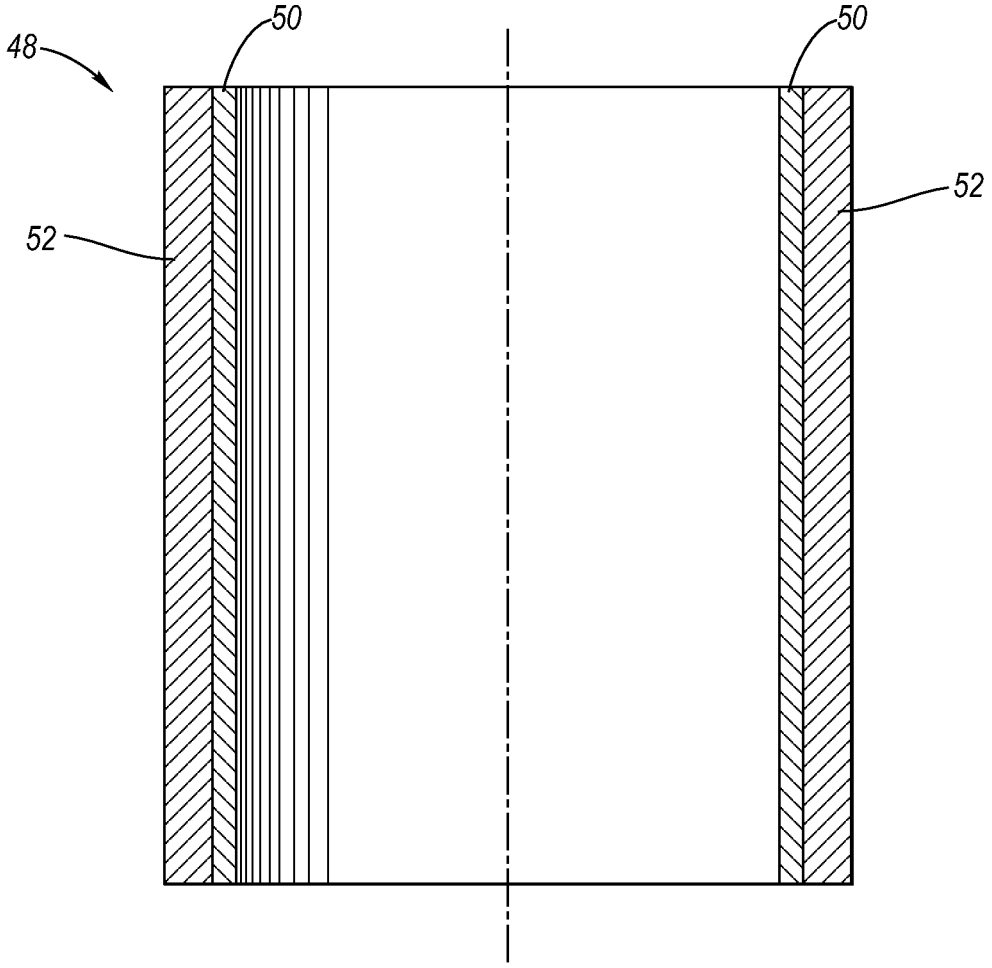
FIG. 7 illustrates a cross-sectional view of a product according to one embodiment.

Referring to FIG. 7, in one embodiment, the method of compacting the first powder-like and/or particulate material 12 and the second powder-like and/or particulate material 28 may be used to produce a product 48, for example but not limited to a thin walled cylinder liner for an engine block. In one embodiment the cylinder liner 48 may include a first thin inner cylinder liner wall or cylinder liner shell 50 and a second thin outer concentric cylinder liner wall or cylinder liner shell 52. When the dual material cylinder liner 48 is positioned in an engine block, the first cylinder liner shell 50 may be in contact with a piston, and the second cylinder liner shell 52 may be in contact with the surface of the engine block (not shown) defining the cylinder bore in a manner known in the art. The first cylinder liner shell 50 may include a first material. In one embodiment, the first material may be a ferrous alloy. In another embodiment, the first material may be a non-ferrous alloy. The first material may be designed to provide suitable microstructure to provide adequate wear resistance of the cylinder liner without unduly increasing the wear of the pistons or the piston rings of the engine block. The second cylinder liner shell 52 may include a second material. The second material may be a non-ferrous alloy, for example, but not limited to, an aluminum or magnesium alloy. The chemical composition of the second material may be designed to eliminate interface related issues in cast microstructures. In another embodiment, the cylinder liner 48 may include the first cylinder liner shell 50 or the second cylinder liner shell 52 but not both. In one embodiment, the first cylinder liner shell 50 and the second cylinder liner shell 52 may each include a sintered material including a cohesive body including a plurality of particles having adjacent surfaces bonded or fused together.

In one embodiment, the first cylinder liner shell 50 produced by the process may have a thickness of about 1 mm to about 2 mm. In another embodiment, the first cylinder liner shell 50 may have a thickness of about 2 mm to about 5 mm. In yet another embodiment, the first cylinder liner shell 50 may have a thickness greater than 5 mm. The thickness of the second cylinder liner shell 52 may depend on the design and geometry of the engine block. In various embodiments, the thickness of the second cylinder liner shell 52 may be about 1 mm to about 3 mm. In another embodiment, the thickness of the second cylinder liner shell 52 may be greater than 3 mm.

The dual material bonded liner 48 may be a pressed-in cylinder liner or a cast-in cylinder liner. In one embodiment, the liner 48 is press fitted into a cylinder bore of a block engine. The liner 48 may be chilled, pressed into the cylinder bore, and allowed to expand to a tight fit as it warms to room temperature. In another embodiment, the liner 48 is cast-in-place, and the liner may be allowed to further densify by the heat from the molten casting alloy of the cylinder block. After the solidification of the cylinder block, the surface of the first cylinder liner shell 50 that is in contact with the piston may be machined using appropriate techniques to achieve required surface finish and dimensions. In another embodiment, the first cylinder liner shell 50 does not need to be machined at all because it was formed in the DMC process at the correct thickness. In one embodiment the first cylinder liner shell 50 may be sinter hardened if higher hardness or martensitic microstructure is desired for the cylinder liner bore walls for higher output engines. Sinter hardening the first cylinder liner shell 50 may render unnecessary any hardening of the liner 48 after the liner is cast-in place or pressed-in place.

The above description of embodiments of the invention is merely exemplary in nature and, thus, variations thereof are not to be regarded as a departure from the spirit and scope of the invention.

What is claimed is:

1. A method comprising:

providing a first layer comprising a first powder material and a second layer comprising a second powder material over the first layer, and compacting the first powder material and the second powder material using at least a first magnetic field wherein compacting a first powder material and a second powder material using at least a first magnetic field comprises providing a first electrically conductive container and placing the first powder material in the first container and wherein the first magnetic field induces a current in the first container producing a second magnetic field so that the first and second magnetic fields repel each other and the first container is compressed to compact the first powder material to provide a first compact, and thereafter sintering at least a portion of the first compact to provide a first sintered component, and thereafter, placing the first sintered component in a second electrically conductive container and placing the second powder material in the second container and so that a third magnetic field produces a current in the second container producing a fourth magnetic field and so that the third magnetic field and the fourth magnetic fields repel each other so that the second container is compressed to compact the second powder material.

2. A method as set forth in claim 1 wherein the first magnetic field and the third magnetic field are generated using a coil.

3. A method as set forth in claim 1 further comprising quenching the first sintered component before placing the first sintered component in the second container.

4. A method as set forth in claim 3 further comprising sintering the compacted second powder material.

5. A method as set forth in claim 4 further comprising quenching the sintered and compacted second powder material.

6. A method as set forth in claim 1 wherein the first electrically conductive container comprises a first circular inner cylindrical wall and a second outer spaced apart concentric circular cylindrical wall to provide a first void between the walls of the first electrically conductive container, and wherein placing the first powder material in the first container comprises placing the first powder material in the first void.

7. A method as set forth in claim 1 wherein placing the first sintered component in a second container comprises placing the first sintered component in the second container so that a second void is provided between a wall of the second container and the outer surface of the first sintered component, and wherein placing the second powder material in the second container comprises placing the second powder material in the second void.

8. A method comprising:

providing a first electrically conductive container comprising a first inner cylindrical wall and a second outer spaced apart concentric cylindrical wall to provide a first void between the walls of the first container;

placing a first powder material in the first void between the walls of the first container;

compacting the first powder material wherein a first magnetic field induces a current in the first container producing a second magnetic field so that the first and second magnetic fields repel each other and the first container is compressed to compact the first powder material to provide a first compact;

sintering at least a portion of the first compact to provide a first sintered component;

placing the first sintered component in a second electrically conductive container comprising a third cylindrical wall so that a second void is provided between the third cylindrical wall and the first sintered component; and placing a second powder material in the second container and so that a third magnetic field produces a current in the second container producing a fourth magnetic field and so that the third magnetic field and the fourth magnetic fields repel each other so that the second container is compressed to compact the second powder material to form a dual material combustion engine cylinder liner.

* * * * *